US011413203B1

(12) United States Patent
Odonnell

(10) Patent No.: US 11,413,203 B1
(45) Date of Patent: Aug. 16, 2022

(54) PATIENT TRANSFER DEVICE

(71) Applicant: Patrick Odonnell, Pawcatuck, CT (US)

(72) Inventor: Patrick Odonnell, Pawcatuck, CT (US)

( * ) Notice: Subject to any disclaimer, the term of this patent is extended or adjusted under 35 U.S.C. 154(b) by 0 days.

(21) Appl. No.: 17/176,225

(22) Filed: Feb. 16, 2021

(51) Int. Cl.
*A61G 7/10* (2006.01)
*A63B 21/16* (2006.01)

(52) U.S. Cl.
CPC ..... *A61G 7/1044* (2013.01); *A61G 7/1038* (2013.01); *A61G 7/1059* (2013.01); *A61G 7/1076* (2013.01); *A61G 7/1096* (2013.01); *A63B 21/1681* (2013.01)

(58) Field of Classification Search
CPC ..... A61G 5/14; A61G 7/1076; A61G 7/1073; A61G 7/053; A61G 7/0533; A61G 7/1044; A61G 7/1038; A61G 7/1059; A61G 7/1096; A61G 2200/34; A61G 7/1046; A61G 2200/36; A63B 21/015; A63B 21/16; A63B 21/1681; F16M 13/027
See application file for complete search history.

(56) References Cited

U.S. PATENT DOCUMENTS

| | | | | |
|---|---|---|---|---|
| 2,757,388 | A | 8/1956 | Effie | |
| 3,911,509 | A | 10/1975 | Fleckenstein | |
| 5,526,541 | A | 6/1996 | Massey | |
| 7,191,477 | B2 | 3/2007 | Hahn | |
| 8,166,588 | B1 * | 5/2012 | Haessly | A47K 17/024 5/83.1 |
| 9,345,631 | B2 | 5/2016 | Daneshvar | |
| 10,092,469 | B1 | 10/2018 | Lillevold | |
| 2006/0162753 | A1 | 7/2006 | Grana | |
| 2009/0283360 | A1 * | 11/2009 | Eckerdt | A61G 7/053 182/100 |
| 2019/0063665 | A1 * | 2/2019 | LeCote | F16M 13/02 |

FOREIGN PATENT DOCUMENTS

| | | |
|---|---|---|
| WO | 2005027812 | 9/2004 |

OTHER PUBLICATIONS

"Stabilize." Vocabulary, Vocabular.com, https://www.vocabulary.com/dictionary/stabilize.*

* cited by examiner

*Primary Examiner* — David R Hare
*Assistant Examiner* — Madison Emanski
(74) *Attorney, Agent, or Firm* — Kyle A. Fletcher, Esq.

(57) ABSTRACT

The patient transfer device comprises a base, a central pole, a ceiling support, a lift system, a horizontal handle, and a support belt. The patient transfer device may be adapted to assist a caregiver in moving a patient from a first seated location to a second seated location by holding the patient in an elevated seated position while the patient is moved from a first rotational orientation to a second rotational orientation. The base may rest on a floor to provide stability. The central pole may rise vertically upwards to the ceiling support. The central pole may be extended using the lift system to press the ceiling support against a ceiling to provide additional support. The horizontal handle and the support belt may be adapted to hold the patient in the elevated seated position while the patient is moved.

18 Claims, 5 Drawing Sheets

PATIENT TRANSFER DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of patient care equipment and patient mobility devices, more specifically, a patient transfer device.

SUMMARY OF INVENTION

The patient transfer device comprises a base, a central pole, a ceiling support, a lift system, a horizontal handle, and a support belt. The patient transfer device may be adapted to assist a caregiver in moving a patient from a first seated location to a second seated location by holding the patient in an elevated seated position while the patient is moved from a first rotational orientation to a second rotational orientation. The base may rest on a floor to provide stability. The central pole may rise vertically upwards to the ceiling support. The central pole may be extended using the lift system to press the ceiling support against a ceiling to provide additional support. The horizontal handle and the support belt may be adapted to hold the patient in the elevated seated position while the patient is moved.

An object of the invention is to move a patient from a first seated location to a second seated location.

Another object of the invention is to provide a central pole coupled between a base that rests on the floor and a ceiling support that may be raised to press against the ceiling using a telescopic cylinder and actuator.

A further object of the invention is to provide a horizontal handle, a support belt, and a knee pad that the patient may use to lift themselves from a seated position.

Yet another object of the invention is to provide a mechanism for rotating the base top, horizontal handle, support belt, and the lower pole section of the central pole to move the patient from a first rotational orientation to a second rotational orientation.

These together with additional objects, features and advantages of the patient transfer device will be readily apparent to those of ordinary skill in the art upon reading the following detailed description of the presently preferred, but nonetheless illustrative, embodiments when taken in conjunction with the accompanying drawings.

In this respect, before explaining the current embodiments of the patient transfer device in detail, it is to be understood that the patient transfer device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the patient transfer device.

It is therefore important that the claims be regarded as including such equivalent construction insofar as they do not depart from the spirit and scope of the patient transfer device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
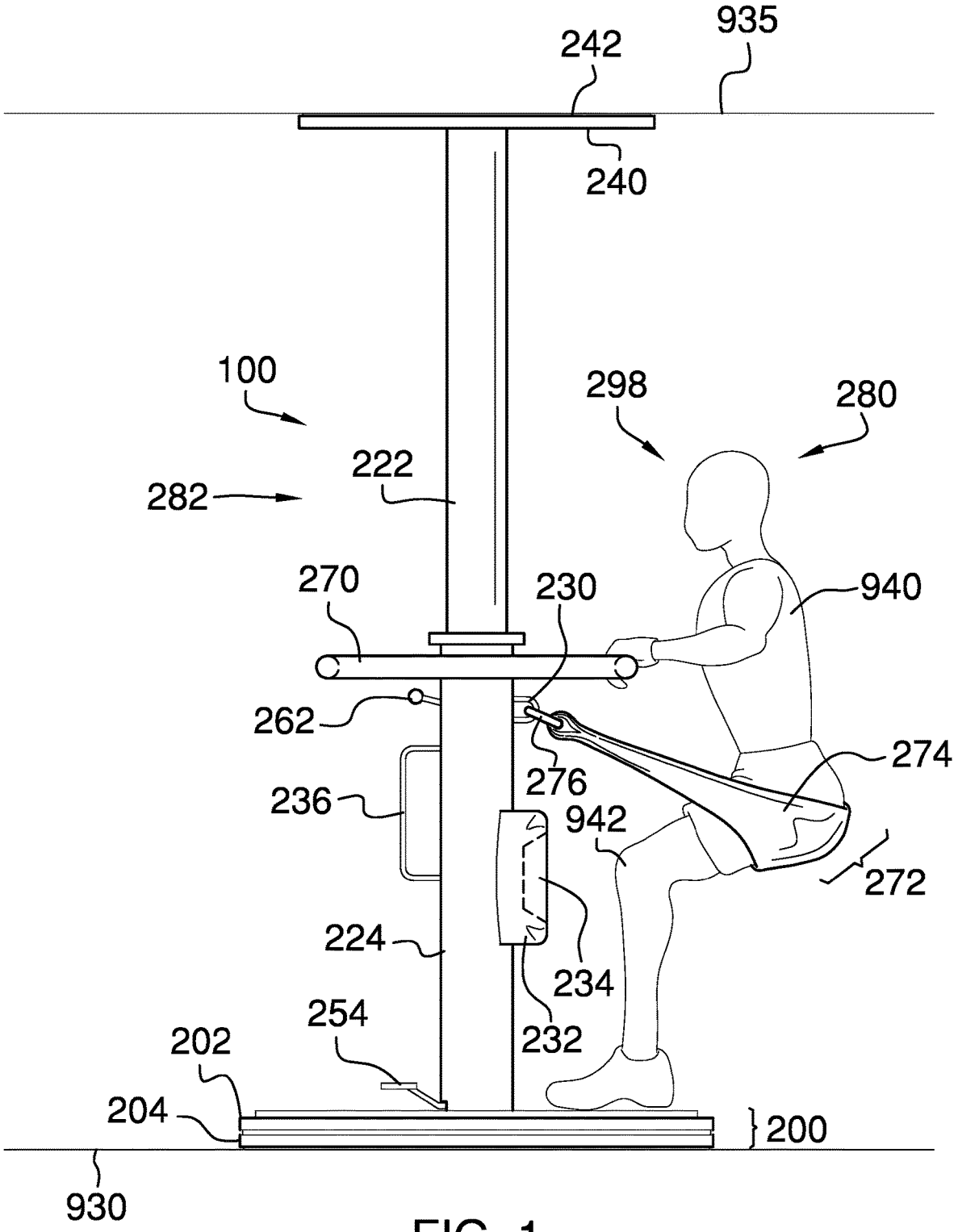
FIG. 1 is a side view of an embodiment of the disclosure illustrating usage of the invention.
Figure 2:
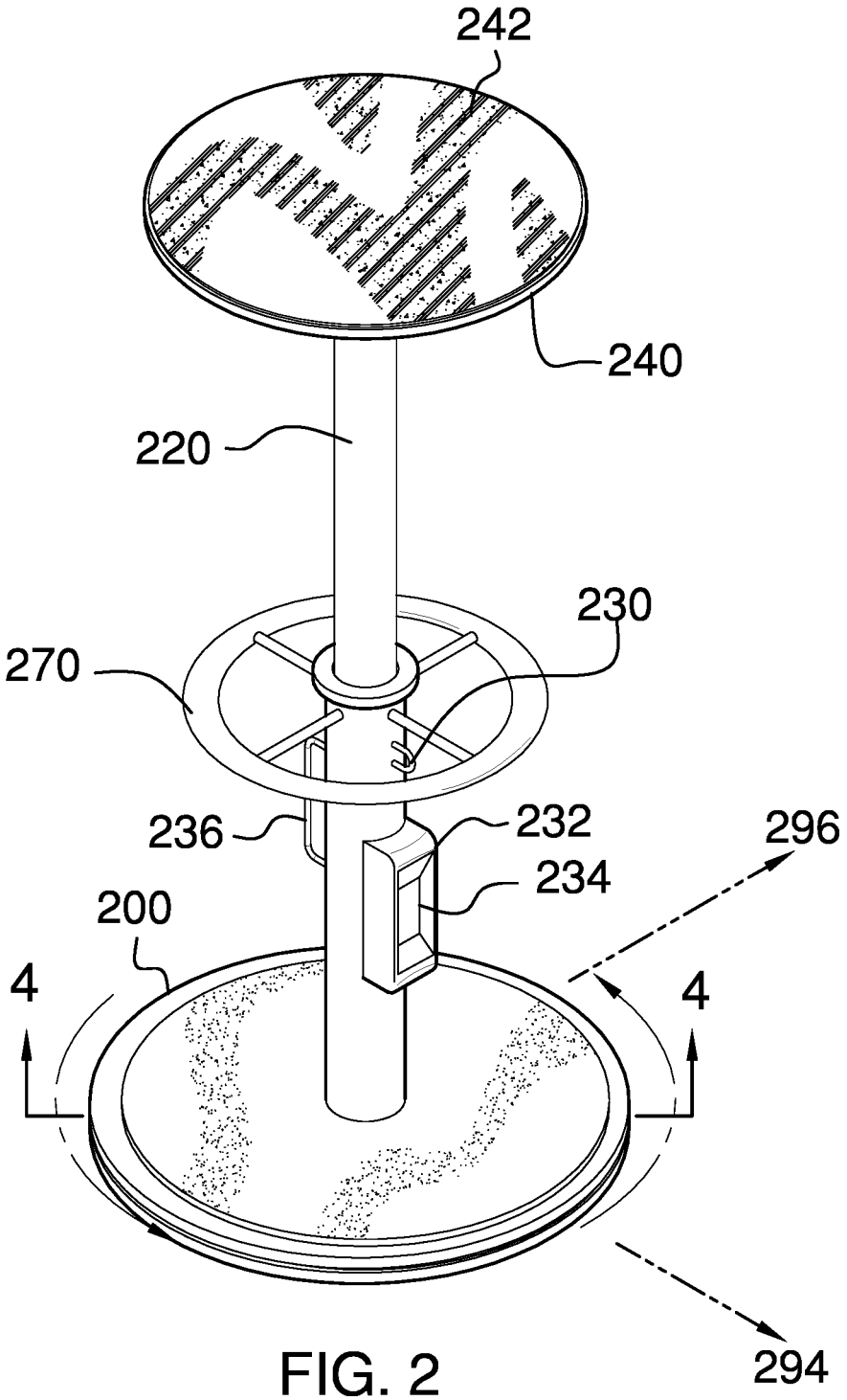
FIG. 2 is an isometric view of an embodiment of the disclosure.
Figure 3:
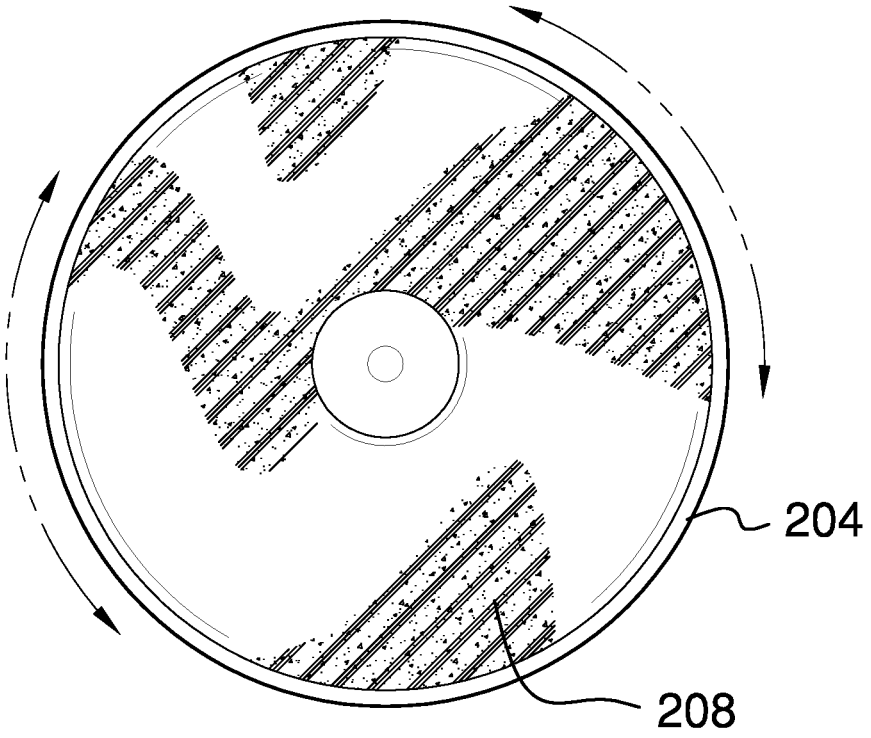
FIG. 3 is a bottom view of an embodiment of the disclosure.
Figure 4:
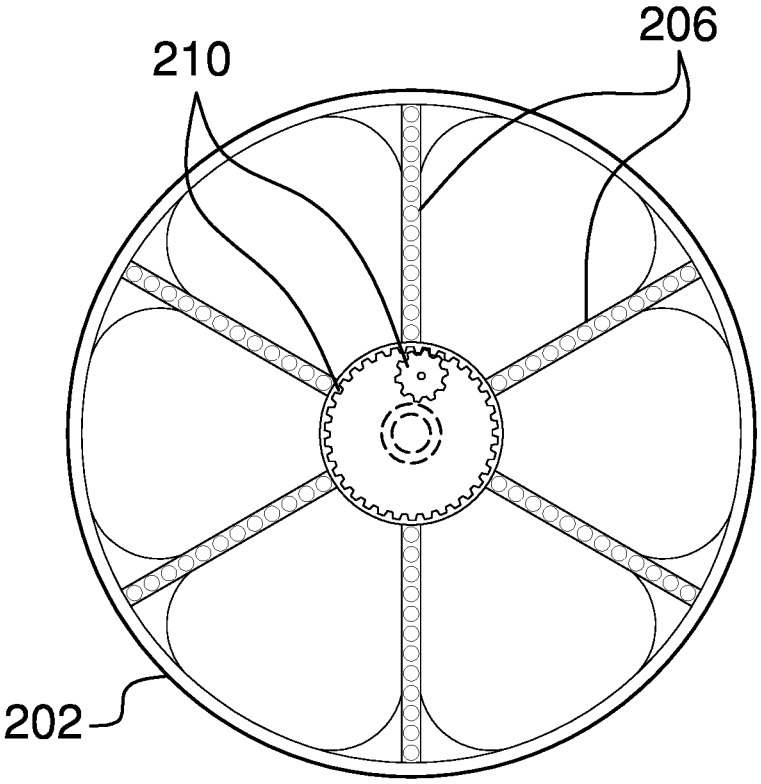
FIG. 4 is a cross-sectional view of an embodiment of the disclosure across 4-4 as shown in FIG. 2.
Figure 5:
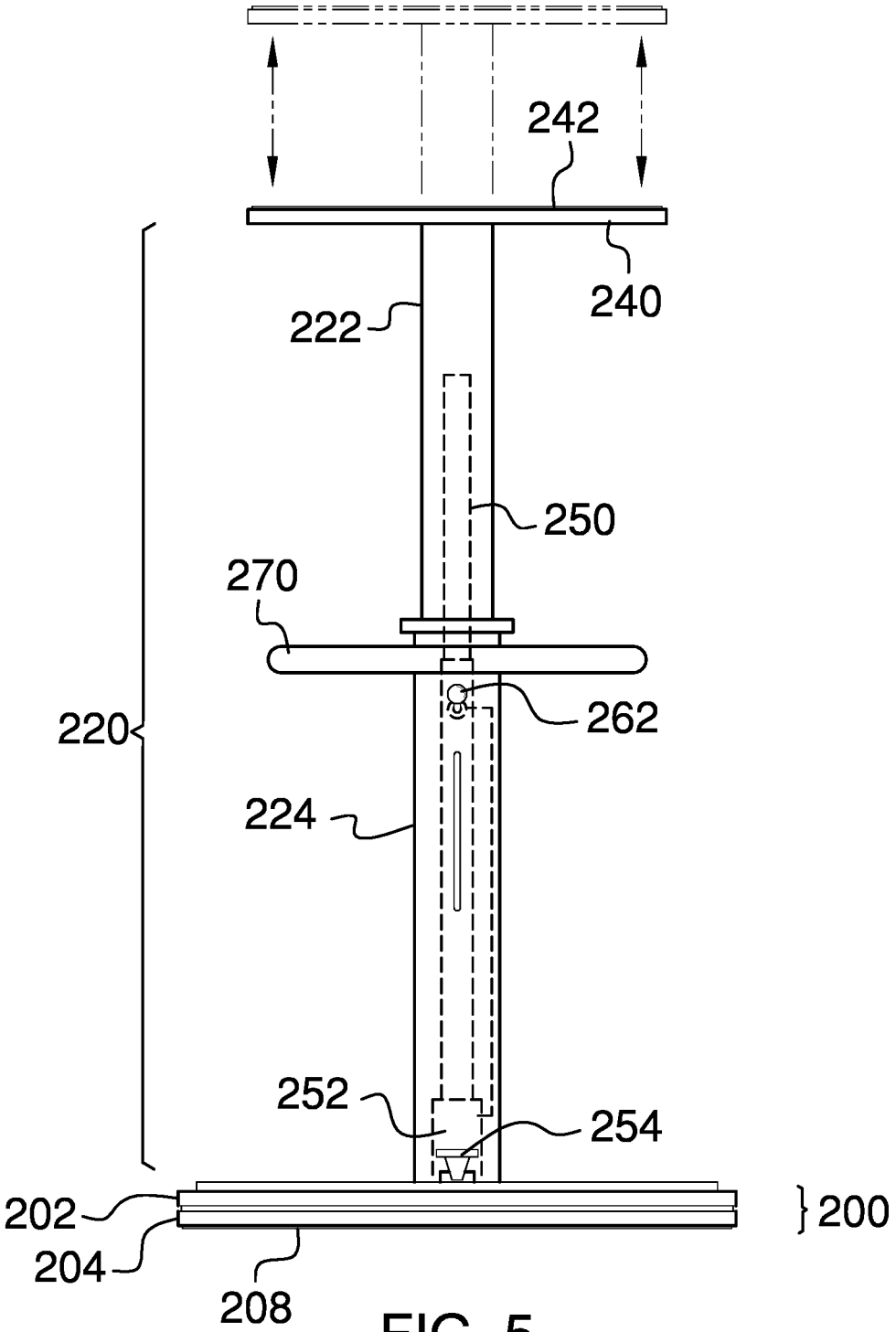
FIG. 5 is a detail view of an embodiment of the disclosure illustrating the telescopic cylinder within the central pole.

Detailed reference will now be made to a first potential embodiment of the disclosure, which is illustrated in FIGS. 1 through 5.

The patient transfer device 100 (hereinafter invention) comprises a base 200, a central pole 220, a ceiling support 240, a lift system, a horizontal handle 270, and a support belt 272. The invention 100 may be adapted to assist a caregiver in moving a patient 940 from a first seated location to a second seated location by holding the patient 940 in an elevated seated position 298 while the patient 940 is moved from a first rotational orientation 294 to a second rotational orientation 296. The base 200 may rest on a floor 930 to provide stability. The central pole 220 may rise vertically upwards to the ceiling support 240. The central pole 220 may be extended using the lift system to press the ceiling support 240 against a ceiling 935 to provide additional support. The horizontal handle 270 and the support belt 272 may be adapted to hold the patient 940 in the elevated seated position 298 while the patient 940 is moved.

The base 200 may be a horizontal circular disk that is divided into a base bottom 204 and a base top 202. The base bottom 204 may be oriented to be parallel to the base top 202. The base bottom 204 may be pivotably coupled to the base top 202 at the center of the base 200 such that the base top 202 may rotate relative to the base bottom 204. A plurality of bearings may be positioned between the base bottom 204 and the base top 202 to reduce rotational friction between the base bottom 204 and the base top 202. The bottom surface of the base 200 may comprise a bottom tread 208 to prevent the base 200 from sliding over the floor 930.

The central pole 220 may be a vertically oriented column. The central pole 220 may comprise an upper pole section 222 and a lower pole section 224. An outside diameter of the upper pole section 222 may be smaller than an inside diameter of the lower pole section 224 such that the upper pole section 222 may slide up and down within the lower pole section 224. The bottom of the lower pole section 224 may be coupled to the top center of the base top 202. The top of the upper pole section 222 may be coupled to the bottom center of the ceiling support 240. The upper pole section 222 may be raised and lowered relative to the lower pole section 224 via the lift system.

The lower pole section 224 may comprise a belt loop 230, a knee pad 232, and a vertical handle 236. The belt loop 230 may be an attachment point for the support belt 272. The knee pad 232 may be a cushioned pad adapted for the patient 940 to place at least one knee 942 against. The knee pad 232 may comprise an indentation 234 that may be adapted to stabilize the at least one knee 942. The knee pad 232 may be located below the belt loop 230. The knee pad 232 and the belt loop 230 may define a patient access side 280 of the invention 100. The vertical handle 236 may be a vertically-oriented grasping point located on the lower pole section 224 opposite the belt loop 230 and the knee pad 232. The vertical handle 236 may be adapted to be grasped by the caregiver to ease the task of moving the patient 940.

The ceiling support 240 may be a horizontal circular disk that is oriented to be parallel to the base 200. The ceiling support 240 may be raised by the lift system to press the top of the ceiling support 240 against the ceiling 935. The top surface of the ceiling support 240 may comprise a top tread 242 to prevent the ceiling support 240 from sliding over the ceiling 935.

The lift system may comprise a telescopic cylinder 250 and an actuator 252. The telescopic cylinder 250 may comprise a plurality of tubes of diminishing diameters such that an inner tube may slide within the confines of an adjacent outer tube. The length of the telescopic cylinder 250 may be collapsed to minimum length when each of the plurality of tubes resides completely within the adjacent outer tube. The length of the telescopic cylinder 250 may be increased when any or all of plurality of tubes slide out of the adjacent outer tube.

The telescopic cylinder 250 may raise the upper pole section 222 relative to the lower pole section 224 by lengthening the telescopic cylinder 250. The telescopic cylinder 250 may lower the upper pole section 222 relative to the lower pole section 224 by collapsing the telescopic cylinder 250.

The actuator 252 may be operable to expand and collapse the telescopic cylinder 250. A foot pedal 254 located on a caregiver access side 282 may be operable to cause the actuator 252 to expand the telescopic cylinder 250 and thus raise the upper pole section 222. A release handle 262 also located on the caregiver access side 282 may be operable to cause the actuator 252 to collapse the telescopic cylinder 250 and thus lower the upper pole section 222.

As non-limiting examples, the telescopic cylinder 250 and the actuator 252 may operate pneumatically, hydraulically, or electrically. In a pneumatic system, the telescopic cylinder 250 may comprise airtight tubes and the actuator 252 may be an air pump. The foot pedal 254 may activate the air pump to force compressed air into the telescopic cylinder 250 and the release handle 262 may actuate an air valve that releases the air pressure within the telescopic cylinder 250. In a hydraulic system, the telescopic cylinder 250 may comprise fluid tight tubes and the actuator 252 may be a hydraulic pump. The foot pedal 254 may activate the hydraulic pump to force hydraulic fluid into the telescopic cylinder 250 and the release handle 262 may actuate a hydraulic valve that releases the hydraulic fluid pressure within the telescopic cylinder 250. In an electrical system, the telescopic cylinder 250 may comprise an internal threaded rod that engages a complementary threaded nut coupled to the inside of the upper pole section 222 and the actuator 252 may be an electric motor. The foot pedal 254 may be a first switch that activates the electric motor using a first polarity to cause the motor to turn in a first rotational direction. The release handle 262 may be a second switch that activates the electric motor using a second polarity to cause the motor to turn in a second rotational direction. In each case, the foot pedal 254 may be operable to cause the telescopic cylinder 250 to expand and the release handle 262 may be operable to cause the telescopic cylinder 250 to collapse.

The horizontal handle 270 may be a circular handrail that may encircle the lower pole section 224 and may be coupled to the lower pole section 224. The horizontal handle 270 may be adapted to be a grasping point for the patient 940.

The support belt 272 may be adapted to support the patient 940 as the patient 940 assumes the elevated seated position 298. As used herein, the elevated seated position 298 may refer to a semi-seated position where the patient 940 or the caregiver lifts the patient 940 to a position above a seat where the patient 940 may be supported from behind by the support belt 272 and by the patient 940 grasping the horizontal handle 270. While in the elevated seated position 298, the patient 940 is neither standing nor seated on a bed, a wheelchair, or a chair. The support belt 272 may comprise a sling 274 which wraps around the rear of the patient 940 and one or more belt couplers 276 located at the opposing ends of the sling 274. The one or more belt couplers 276 may be adapted to couple to the belt loop 230 to support the patient 940 using the central pole 220.

The sequence for moving the patient 940 is as follows: The horizontal handle 270 may be adapted to be grasped by the patient 940 while the patient 940 is seated at the first seated location. The knee pad 232 may be adapted for the patient 940 to place the at least one knee 942 into the indentation 234. The support belt 272 may be adapted to hold the patient 940 in the elevated seated position 298 after the patient 940 is lifted from the first seated location either by themselves or with assistance. The base top 202 may rotate from the first rotational orientation 294, aligned with the first seated location, to the second rotational orientation 296, aligned with the second seated location. As the base top 202 rotates, the lower pole section 224, the horizontal handle 270, and the support belt 272 may be adapted to rotate and to carry the patient 940 from the first rotational orientation 294 to the second rotational orientation 296. The support belt 272 may be adapted to be released from the belt loop 230 on the lower pole section 224 such that the patient 940 may be lowered to the second seated location.

In some embodiments, gearing 210 within the base 200 may be adapted to convert rotation of the central pole 220 into rotation of the base top 202 such that the patient 940 may move from the first rotational orientation 294 to the second rotational orientation 296 by rotating the central pole 220 via the horizontal handle 270.

In use, the invention 100 may be moved into position adjacent to the patient 940. The foot pedal 254 may be activated to raise the ceiling support 240 until the ceiling support 240 presses against the ceiling 935 for stability. The patient 940 may grasp the horizontal handle 270 while the patient 940 is seated at the first seated location. The patient 940 may place at least one knee 942 into the indentation 234 on the knee pad 232. The patient 940 may grasp the horizontal handle 270. The patient 940 may pull themselves up to the elevated seated position 298, with or without assistance. The support belt 272 may be coupled to the belt loop 230 on the lower pole section after passing around the patient 940 and may hold the patient 940 in the elevated seated position 298. The caregiver may rotate the base top 202, the lower pole section 224, the horizontal handle 270, the support belt 272, and the patient 940 from the first rotational orientation 294, aligned with the first seated location, to the second rotational orientation 296, aligned with the second seated location using the vertical handle 236 and/or a foot on the base top 202. The support belt 272 may be released from the belt loop 230 on the lower pole section 224 such that the patient 940 may be lowered to the second seated location. The release handle 262 may be activated to lower the ceiling support 240 away from the ceiling 935 and the invention 100 may be moved away from the patient 940.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "airtight" may refer to a container or seal that is impermeable to air.

In this disclosure, "compressed air" may refer to air that has been compressed to a pressure greater than atmospheric pressure.

As used herein, the words "couple", "couples", "coupled" or "coupling", may refer to connecting, either directly or indirectly, and does not necessarily imply a mechanical connection.

As used in this disclosure, a "cylinder" may be a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder which is defined as a cylinder wherein the curved surface perpendicularly intersects with the two identical flat and parallel ends.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "disk" may be a cylindrically shaped object with parallel opposing sides. A disk generally has a thickness (as measured from flat side to flat side) that is less than the radius of the cylinder.

As used in this disclosure, an "electric motor" may be a device that converts electric energy into rotational mechanical energy.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used in this disclosure, "horizontal" may be a directional term that refers to a direction that is perpendicular to the local force of gravity. Unless specifically noted in this disclosure, the horizontal direction is always perpendicular to the vertical direction.

As used herein, "inside diameter" or "inner diameter" may refer to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, "orientation" may refer to the positioning and/or angular alignment of a first object relative to a second object or relative to a reference position or reference direction.

As used herein, "outside diameter" or "outer diameter" may refer to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "patient" may be a person who is designated to receive a medical treatment, therapy, or service. The term patient may be extended to an animal when used within the context of the animal receiving veterinary treatment or services As used in this disclosure, a "pump" may be a mechanical or electromechanical device that uses suction or pressure to raise or move fluids, compress fluids, or force a fluid into an inflatable object. As non-limiting examples, fluids may include both liquids, such as water, and gases, such as air.

As used in this disclosure, a "sling" may refer to a structure that is used to support, cradle or hoist an object, generally from above.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, "telescopic", "telescoping", and "telescopically" refer to an object made of sections that fit or slide into each other such that the object can be made longer or shorter by adjusting the relative positions of the sections.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

As used in this disclosure, "vertical" may refer to a direction that is parallel to the local force of gravity. Unless specifically noted in this disclosure, the vertical direction is always perpendicular to horizontal.

As used in this disclosure, a "wheelchair" may be a chair fitted with four wheels and used for transporting a patient. The wheelchair is commonly used for sick or disabled persons.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A patient transfer device comprising:

a base, a central pole, a ceiling support, a lift system, a horizontal handle, and a support belt;

wherein the patient transfer device is adapted to assist a caregiver in moving a patient from a first seated location to a second seated location by holding the patient in an elevated seated position while the patient is moved from a first rotational orientation to a second rotational orientation;

wherein the horizontal handle and the support belt are adapted to hold the patient in the elevated seated position while the patient is moved;

wherein the central pole comprises an upper pole section and a lower pole section;

wherein the lift system comprises a telescopic cylinder and an actuator;

wherein the actuator is operable to expand and collapse the telescopic cylinder;

wherein a foot pedal located on a caregiver access side is operable to cause the actuator to expand the telescopic cylinder and thus raise the upper pole section;

wherein a release handle also located on the caregiver access side is operable to cause the actuator to collapse the telescopic cylinder and thus lower the upper pole section.

2. The patient transfer device according to claim 1 wherein the base rests on a floor;

wherein the central pole rises vertically upwards to the ceiling support;

wherein the central pole is extended using the lift system to press the ceiling support against a ceiling;

wherein the base is a horizontal circular disk that is divided into a base bottom and a base top;

wherein the base bottom is oriented to be parallel to the base top;

wherein the base bottom is pivotably coupled to the base top at the center of the base such that the base top rotates relative to the base bottom.

3. The patient transfer device according to claim 2 wherein a plurality of bearings are positioned between the base bottom and the base top to reduce rotational friction between the base bottom and the base top.

4. The patient transfer device according to claim 3 wherein the bottom surface of the base comprises a bottom tread to prevent the base from sliding over the floor.

5. The patient transfer device according to claim 4 wherein the central pole is a vertically oriented column;

wherein an outside diameter of the upper pole section is smaller than an inside diameter of the lower pole section such that the upper pole section slides up and down within the lower pole section.

6. The patient transfer device according to claim 5 wherein the bottom of the lower pole section is coupled to the top center of the base top;

wherein the top of the upper pole section is coupled to the bottom center of the ceiling support.

7. The patient transfer device according to claim 6 wherein the upper pole section is raised and lowered relative to the lower pole section via the lift system.

8. The patient transfer device according to claim 7 wherein the lower pole section comprises a belt loop, a knee pad, and a vertical handle;

wherein the belt loop is an attachment point for the support belt.

9. The patient transfer device according to claim 8 wherein the knee pad is a cushioned pad adapted for the patient to place at least one knee against;

wherein the knee pad comprises an indentation that is adapted to stabilize the at least one knee;

wherein the knee pad is located below the belt loop;

wherein the knee pad and the belt loop define a patient access side.

10. The patient transfer device according to claim 9 wherein the vertical handle is a vertically-oriented grasping point located on the lower pole section opposite the belt loop and the knee pad;

wherein the vertical handle is adapted to be grasped by the caregiver.

11. The patient transfer device according to claim 10 wherein the ceiling support is a horizontal circular disk that is oriented to be parallel to the base;

wherein the ceiling support is raised by the lift system to press the top of the ceiling support against the ceiling.

12. The patient transfer device according to claim 11 wherein the top surface of the ceiling support comprises a top tread to prevent the ceiling support from sliding over the ceiling.

13. The patient transfer device according to claim 12 wherein the telescopic cylinder comprises a plurality of tubes of diminishing diameters such that an inner tube slides within the confines of an adjacent outer tube;

wherein the length of the telescopic cylinder is collapsed to minimum length when each of the plurality of tubes resides completely within the adjacent outer tube;

wherein the length of the telescopic cylinder is increased when any or all of plurality of tubes slide out of the adjacent outer tube.

14. The patient transfer device according to claim 13 wherein the telescopic cylinder raises the upper pole section relative to the lower pole section by lengthening the telescopic cylinder;

wherein the telescopic cylinder lowers the upper pole section relative to the lower pole section by collapsing the telescopic cylinder.

15. The patient transfer device according to claim 14 wherein the horizontal handle is a circular handrail that encircles the lower pole section and is coupled to the lower pole section;

wherein the horizontal handle is adapted to be a grasping point for the patient.

16. The patient transfer device according to claim 15 wherein the support belt is adapted to support the patient as the patient assumes the elevated seated position;

wherein the support belt comprises a sling which wraps around the rear of the patient and one or more belt couplers located at the opposing ends of the sling;

wherein the one or more belt couplers are adapted to couple to the belt loop to support the patient using the central pole.

17. The patient transfer device according to claim 16 wherein the horizontal handle is adapted to be grasped by the patient while the patient is seated at the first seated location;

wherein the knee pad is adapted for the patient to place the at least one knee into the indentation;

wherein the support belt is adapted to hold the patient in the elevated seated position after the patient is lifted from the first seated location;

wherein the base top rotates from the first rotational orientation, aligned with the first seated location, to the second rotational orientation, aligned with the second seated location;

wherein as the base top rotates, the lower pole section, the horizontal handle, and the support belt are adapted to rotate and to carry the patient from the first rotational orientation to the second rotational orientation;

wherein the support belt is adapted to be released from the belt loop on the lower pole section such that the patient is lowered to the second seated location.

18. The patient transfer device according to claim 17 wherein gearing within the base is adapted to convert rotation of the central pole into rotation of the base top such that the patient moves from the first rotational orientation to the second rotational orientation by rotating the central pole via the horizontal handle.

* * * * *